US009236060B2

(12) United States Patent
Matsumoto

(10) Patent No.: US 9,236,060 B2
(45) Date of Patent: Jan. 12, 2016

(54) NOISE SUPPRESSION DEVICE AND METHOD

(71) Applicant: FUJITSU LIMITED, Kawasaki-shi, Kanagawa (JP)

(72) Inventor: Chikako Matsumoto, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 157 days.

(21) Appl. No.: 14/103,443

(22) Filed: Dec. 11, 2013

(65) Prior Publication Data

US 2014/0200886 A1 Jul. 17, 2014

(30) Foreign Application Priority Data

Jan. 15, 2013 (JP) ..... 2013-004734

(51) Int. Cl.
*G10L 21/0208* (2013.01)
*G10L 21/0216* (2013.01)
*H04R 3/00* (2006.01)

(52) U.S. Cl.
CPC ..... *G10L 21/0208* (2013.01); *G10L 21/0216* (2013.01); *H04R 3/005* (2013.01); *G10L 2021/02166* (2013.01); *H04R 2430/20* (2013.01)

(58) Field of Classification Search
CPC ..... G10L 21/0206; G10L 21/0216; G10L 2021/02166; H04R 3/005; H04R 230/20
USPC ..... 700/94; 704/226; 381/71.4, 89, 97
See application file for complete search history.

(56) References Cited

U.S. PATENT DOCUMENTS

2006/0215854 A1* 9/2006 Suzuki et al. ..... 381/98
2009/0089053 A1* 4/2009 Wang et al. ..... 704/233
2010/0323652 A1* 12/2010 Visser et al. ..... 455/232.1

FOREIGN PATENT DOCUMENTS

| | | | |
|---|---|---|---|
| EP | 2431973 | A1 | 3/2012 |
| JP | 7-39000 | | 2/1995 |
| JP | 2002-530966 | | 9/2002 |
| JP | 2010-176105 | | 8/2010 |
| WO | WO00/30404 | | 5/2000 |
| WO | 2010144577 | A1 | 12/2010 |
| WO | 2011103488 | A1 | 8/2011 |

OTHER PUBLICATIONS

EESR—European Search Report mailed on Mar. 27, 2014 for corresponding European Application No. 13196886.9.

* cited by examiner

*Primary Examiner* — Paul McCord
(74) *Attorney, Agent, or Firm* — Fujitsu Patent Center

(57) ABSTRACT

A noise suppression device includes a phase difference derived suppression coefficient computation section that over a phase difference utilization range computes for each frequency a phase difference derived suppression coefficient based on a phase difference, an amplitude ratio derived suppression coefficient computation section that computes for each frequency an amplitude ratio derived suppression coefficient based on an amplitude ratio or an amplitude difference, and based on the amplitude conditions, and a suppression section that suppresses noise contained in the input sound signals based on a suppression coefficient determined by using the phase difference derived suppression coefficient and the amplitude ratio derived suppression coefficient.

24 Claims, 12 Drawing Sheets

NOISE SUPPRESSION DEVICE AND METHOD

CROSS-REFERENCE TO RELATED APPLICATION

This application is based upon and claims the benefit of priority of the prior Japanese Patent Application No. 2013-004734, filed on Jan. 15, 2013, the entire contents of which are incorporated herein by reference.

FIELD

The embodiments discussed herein are related to a noise suppression device, a noise suppression method and to a storage medium storing a noise suppression program.

BACKGROUND

Noise suppression is conventionally performed, for example, in a vehicle mounted car navigation system, a hands-free phone, or a telephone conference system, to suppress noise contained in a speech signal that has mixed-in noise other than a target voice (for example a person's speech). A technique employing a microphone array including plural microphones is known as such noise suppression technology.

In such conventional noise suppression technology using a microphone array, a method has been disclosed in which a phase difference computed from respective input signals to each of the microphones in the microphone array is employed to derive a value representing the likelihood of a sound source being in a specific direction. In this method, based on the derived value, sound signals from sound sources other than the sound source in the specific direction are suppressed. A method has also been described that utilizes an amplitude ratio between input signals of each of the microphones to suppress sound other than from a target direction.

For example, a technique has been proposed that respectively divides waveforms acquired at two points into plural frequency bands, derives time differences and amplitude ratios for each band, and eliminates waveforms that do not match an arbitrarily determined time difference and amplitude ratio. In such a technique, after waveform processing and laying out each of the bands alongside each other, it is possible to selectively extract only the sound of a source at an arbitrary position (direction) by adding together the outputs of each of the bands. Moreover, in this technique, when selectively extracting sound from a sound source that has a difference in distance from two microphones, the phase difference or amplitude ratio are aligned with each other by performing signal delay or amplitude amplification, and then waveforms whose phase difference or amplitude ratio do not match are removed.

There has also been a proposal for a technique in which phase differences are detected between microphones by employing a target sound source direction estimated from the sound received from two or more microphones, and then using the detected phase differences to update a central phase difference value. In such a technique, a noise suppression filter generated using the updated central value is employed to suppress noise received by the microphones, and then sound is output.

There has also been a proposal for a technique in which audible signals received from two sensors placed in various different places are converted, spectral signals arise, a spectral signal is delayed, and many intermediate signals are supplied. Each of the intermediate signals corresponds to different spatial positions with respect to the two sensors, and the locations of noise sources and a desired emitting source, together with the spectral content of the desired signal, are determined from the intermediate signals corresponding to the location of the noise source.

RELATED PATENT DOCUMENTS

Japanese Laid-Open Patent Publication No. H07-039000
Japanese Laid-Open Patent Publication No. 2010-176105
Japanese Laid-Open Patent Publication No. 2002-530966

SUMMARY

According to an aspect of the embodiments, a noise suppression device includes: a phase difference utilization range computation section that, based on an inter-microphone distance between plural microphones contained in a microphone array and on a sampling frequency, computes, as a phase difference utilization range, a frequency band in which phase rotation of phase difference does not occur for each frequency between respective input sound signals containing a target voice and noise that are input from each of the plural microphones; an amplitude condition computation section that, based on an amplitude ratio or an amplitude difference for each frequency between the input sound signals, computes amplitude conditions to determine whether or not the input sound signals are the target voice or the noise based on the inter-microphone distance and a position of a sound source of the target voice; a phase difference derived suppression coefficient computation section that, over the phase difference utilization range computed by the phase difference utilization range computation section, computes, for each frequency, a phase difference derived suppression coefficient based on a phase difference; an amplitude ratio derived suppression coefficient computation section that computes, for each frequency, an amplitude ratio derived suppression coefficient based on the amplitude ratio or the amplitude difference, and based on the amplitude conditions computed by the amplitude condition computation section; and a suppression section that suppresses noise contained in the input sound signals based on a suppression coefficient determined using the phase difference derived suppression coefficient and the amplitude ratio derived suppression coefficient.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Detailed explanation follows regarding an example of an exemplary embodiment of technology disclosed herein, with reference to the drawings.

First Exemplary Embodiment

Figure 1:
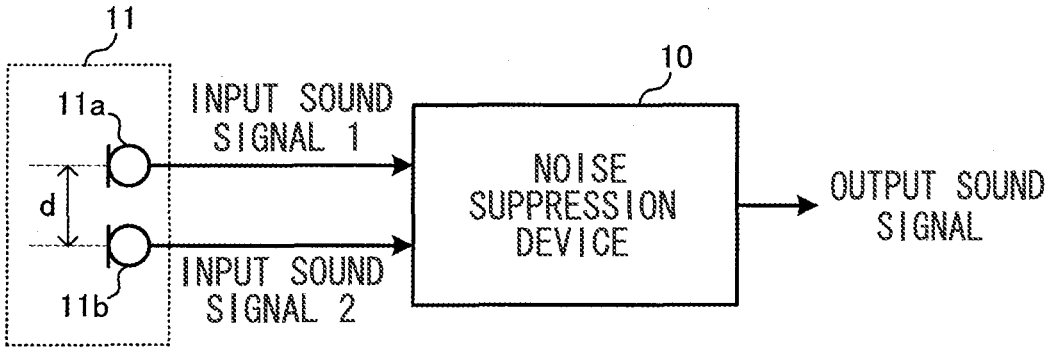
FIG. 1 is a block diagram illustrating an example of a configuration of a noise suppression device according to a first exemplary embodiment.

FIG. 1 illustrates a noise suppression device 10 according to a first exemplary embodiment. A microphone array 11 of plural microphones arrayed at specific intervals is connected to the noise suppression device 10. There are at least two microphones included in the microphone array 11. Explanation follows regarding an example in which two microphones are included, a microphone 11*a* and a microphone 11*b*.

The microphones 11*a* and 11*b* collect peripheral sound, convert the collected sound into an analogue signal and output the analogue signal. The signal output from the microphone 11*a* is input sound signal 1 and the signal output from the microphone 11*b* is input sound signal 2. Noise other than the target voice (a voice from a target source, such as for example the voice of a person talking) is mixed into the input sound signal 1 and the input sound signal 2. The input sound signals 1 and 2 output from the microphone array 11 are input to the noise suppression device 10. In the noise suppression device 10 an output sound signal is generated, in which noise contained in the input sound signals 1 and 2 that were input has been suppressed, and then output.

Figure 2:
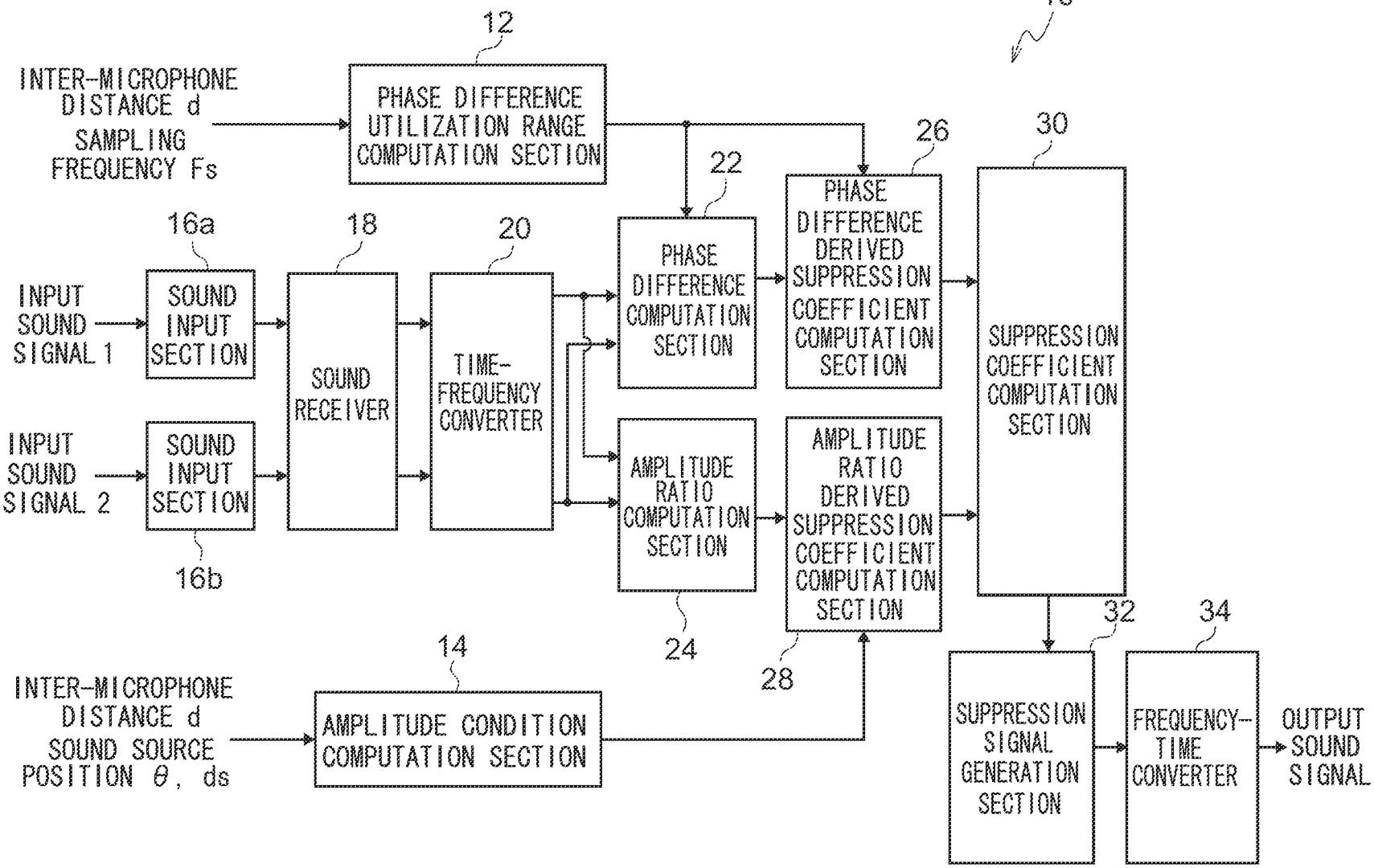
FIG. 2 is a block diagram illustrating an example of a functional configuration of a noise suppression device according to the first exemplary embodiment.

As illustrated in FIG. 2, the noise suppression device 10 includes a phase difference utilization range computation section 12, an amplitude condition computation section 14, sound input sections 16*a*, 16*b*, a sound receiver 18, a time-frequency converter 20, a phase difference computation section 22 and an amplitude ratio computation section 24. The noise suppression device 10 includes a phase difference derived suppression coefficient computation section 26, an amplitude ratio derived suppression coefficient computation section 28, a suppression coefficient computation section 30, a suppression signal generation section 32 and a frequency-time converter 34. Note that the phase difference computation section 22 and the phase difference derived suppression coefficient computation section 26 are an example of a phase difference derived suppression coefficient computation section of technology disclosed herein. The amplitude ratio computation section 24 and the amplitude ratio derived suppression coefficient computation section 28 are an example of an amplitude ratio derived suppression coefficient computation section of technology disclosed herein. The suppression coefficient computation section 30 and the suppression signal generation section 32 are an example of a suppression section of technology disclosed herein.

Based on the inter-microphone distance and the sampling frequency, the phase difference utilization range computation section 12 computes a frequency band in which the phase difference is utilizable to compute suppression coefficients to suppress noise contained in the input sound signal 1 and the input sound signal 2.

Figure 3:
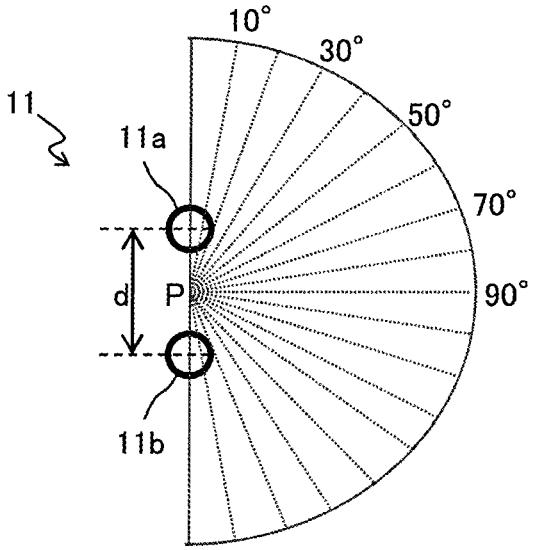
FIG. 3 is a schematic diagram illustrating an example of microphone array placement.

Explanation next follows regarding a relationship between inter-microphone distance and sampling frequency, and the phase difference between the input sound signal 1 and the input sound signal 2 (the difference in phase spectra for the same frequency). In the present exemplary embodiment, as illustrated in FIG. 3, the sound source direction where a sound source is present with respect to the microphone array 11 is expressed by an angle formed between a straight line through the centers of two microphones and a line segment that has one end at a central point P at the center of the two microphones and the other end at the sound source.

Figure 4:
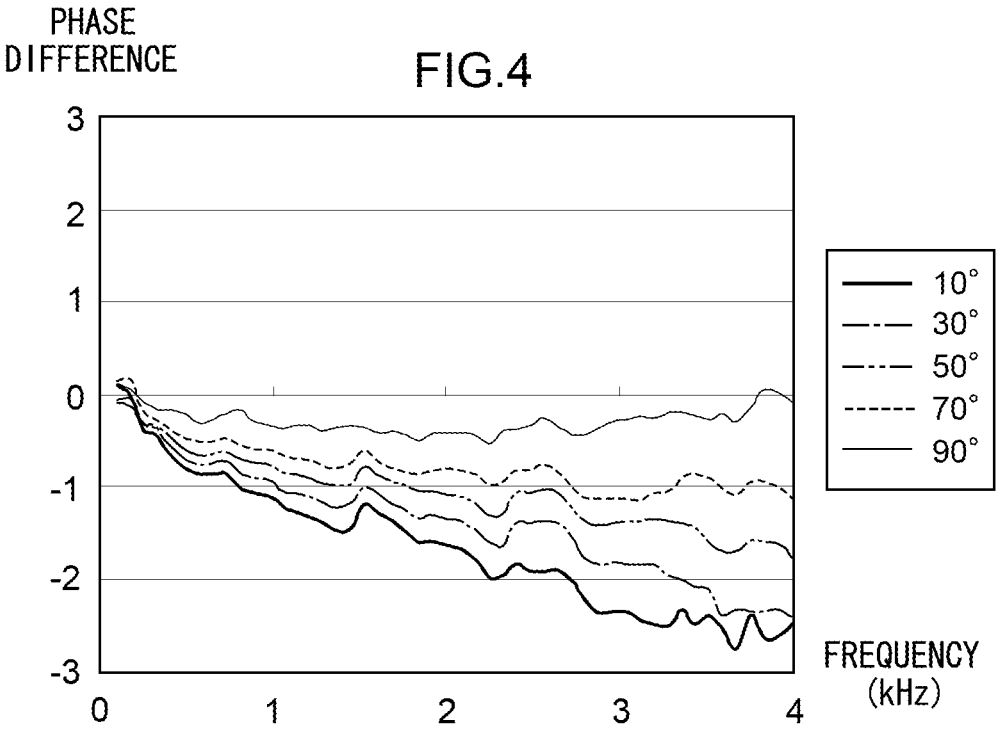
FIG. 4 is a graph illustrating an example of phase difference when an inter-microphone distance is short.
Figure 5:
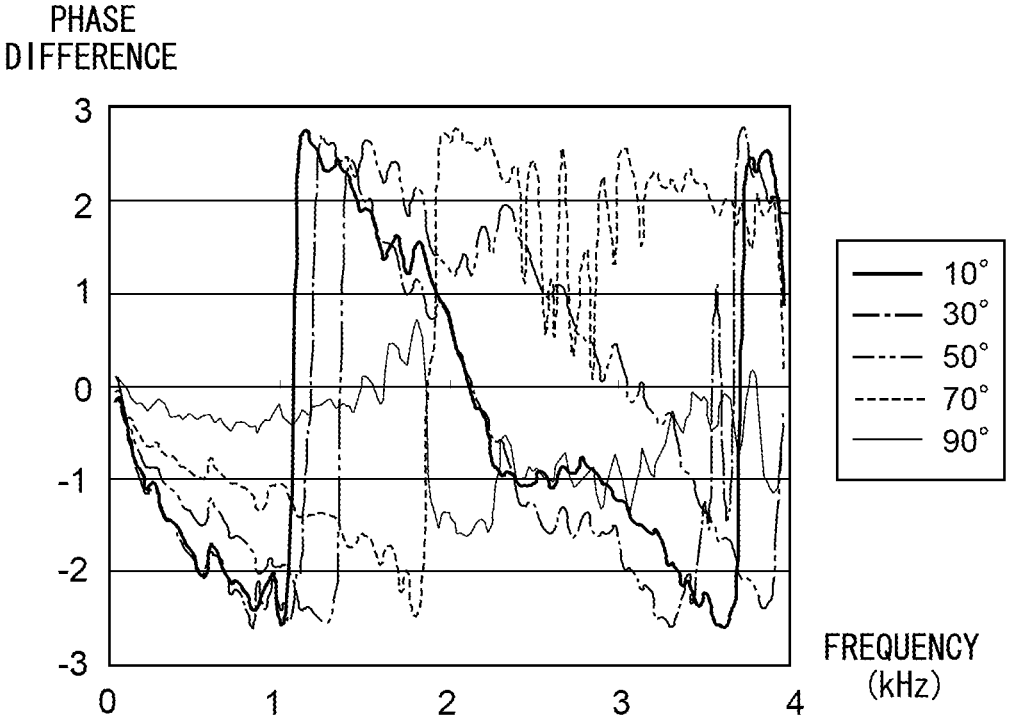
FIG. 5 is a graph illustrating an example of phase difference when an inter-microphone distance is long.

FIG. 4 is a graph representing the phase difference between the input sound signal 1 and the input sound signal 2 for each sound source direction when the inter-microphone distance d between the microphone 11*a* and the microphone 11*b* is smaller than the speed of sound c/sampling frequency Fs. FIG. 5 is a graph representing the phase difference between the input sound signal 1 and the input sound signal 2 for each sound source direction when the inter-microphone distance d is larger than the speed of sound c/the sampling frequency Fs. Sound source directions of 10°, 30°, 50°, 70°, 90° are illustrated in FIG. 4 and FIG. 5.

As illustrated in FIG. 4, since phase rotation does not occur in any sound source direction when the inter-microphone distance d is smaller than speed of sound c/sampling frequency Fs, there is no impediment to utilizing the phase difference to determine whether or not the input sound signal is the target voice or noise. However, as illustrated in FIG. 5, when the inter-microphone distance d is larger than speed of sound c/sampling frequency Fs, phase rotation occurs in a high region frequency band that is higher than a given frequency (in the vicinity of 1 kHz in the example of FIG. 5). When phase rotation occurs, it becomes difficult to utilize phase difference to determine whether or not there is the target voice or noise present, such that appropriate noise suppression is not possible. Namely, an issue arises in that inter-microphone distance becomes a constraint when phase difference is utilized for noise suppression.

In the phase difference utilization range computation section 12, a frequency band is computed based on the inter-microphone distance d and the sampling frequency Fs such that phase rotation in the phase difference between the input sound signal 1 and the input sound signal 2 does not arise. Then the computed frequency band is set as a phase difference utilization range for determining by utilizing phase difference whether or not there is a target voice or noise present.

More specifically, the phase difference utilization range computation section 12 uses the inter-microphone distance d, the sampling frequency Fs and the speed of sound c to computed an upper limit frequency $F_{max}$ of the phase difference utilization range according to the following Equations (1) and (2).

$$F_{max}=Fs/2 \text{ when } d \leq c/Fs \quad (1)$$

$$F_{max}=c/(d*2) \text{ when } d>c/Fs \quad (2)$$

The phase difference utilization range computation section 12 sets a frequency band of the computed $F_{max}$ or lower as the phase difference utilization range.

The amplitude condition computation section 14 computes amplitude conditions based on the inter-microphone distance d and the position of the target voice for use when determining whether or not the input sound signal is a target voice or noise based on the amplitude ratio (or amplitude difference) between the amplitude of the input sound signal 1 and the amplitude of the input sound signal 2.

Figure 6:
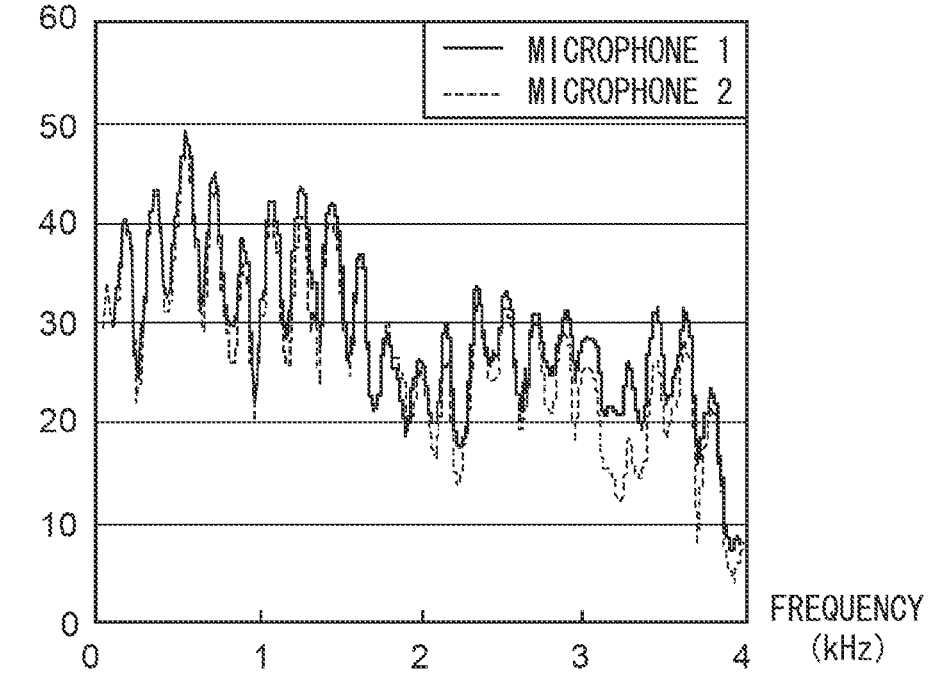
FIG. 6 is a graph illustrating an example of amplitude when an inter-microphone distance is short.
Figure 7:
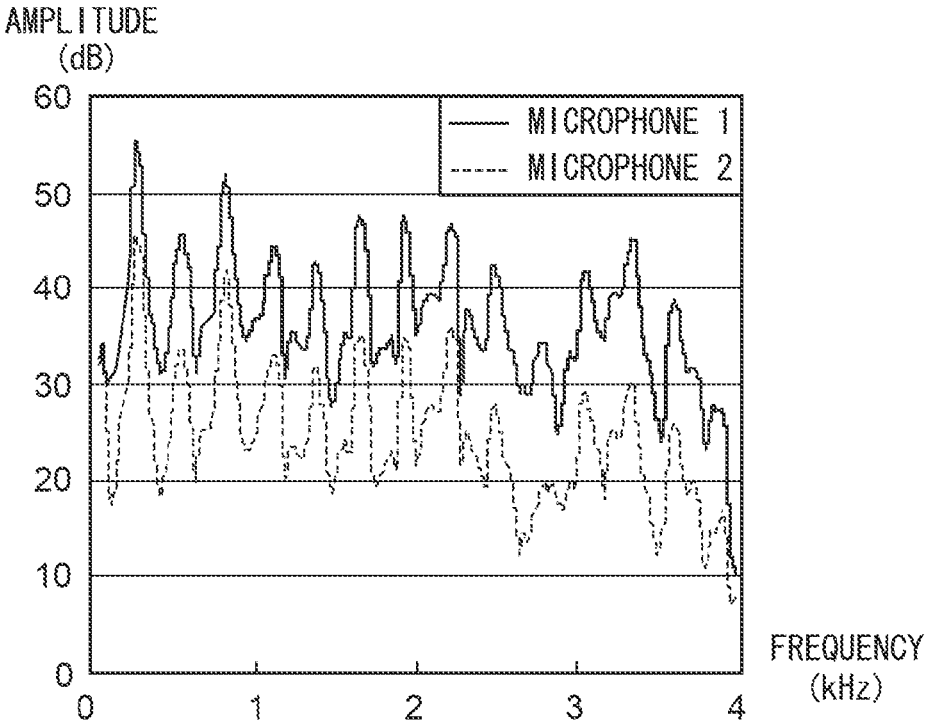
FIG. 7 is a graph illustrating an example of amplitude when an inter-microphone distance is long.

Explanation follows regarding a relationship between the inter-microphone distance and the position of the target voice, and the amplitude ratio between the input sound signal 1 and the input sound signal 2 (the ratio of amplitude spectra at the same frequency). FIG. 6 is a graph of a case in which the inter-microphone distance d between the microphone 11*a* and the microphone 11*b* is smaller than the speed of sound c/sampling frequency Fs, and illustrates respective amplitudes of the input sound signal 1 and the input sound signal 2 when the sound source is at a sound source direction of 30°. FIG. 7 is a graph of a case in which the inter-microphone distance d is larger than the speed of sound c/sampling frequency Fs, and illustrates respective amplitudes of the input sound signal 1 and the input sound signal 2 when the sound source is at a sound source direction of 30°.

As illustrated in FIG. 6, the difference in amplitude between the two input sound signals is small when the inter-microphone distance d is smaller than the speed of sound c/sampling frequency Fs. However, as illustrated in FIG. 7, the difference in amplitude is large when the inter-microphone distance d is larger than the speed of sound c/sampling frequency Fs. Moreover, FIG. 6 and FIG. 7 are examples when the sound source is at a sound source direction of 30°, however the difference in amplitudes is greatly influenced by the sound source direction. For a sound source with a sound source direction of 90° (a direction perpendicular to a straight line passing through the centers of the two microphones), the amplitude difference is small, and the amplitude difference rapidly increases on progression away from the sound source direction 90° (nearer to the sound source direction 0° or) 180°. There is a drop off in the suppression amount and audio distortion occurs when during noise suppression the amplitude conditions are not set in consideration of such changes in amplitude ratio according to the inter-microphone distance d and the sound source position.

Based on the inter-microphone distance d and the sound source position, the amplitude condition computation section 14 accordingly computes the amplitude conditions for determining whether or not the input sound signal is the target voice or noise based on the amplitude ratio of the input sound signal 1 and the input sound signal 2. A range of amplitude ratios expressed by an upper limit and a lower limit to the amplitude ratio capable of determining whether or not the input sound signal is the target voice is then computed as the amplitude conditions.

Figure 8:
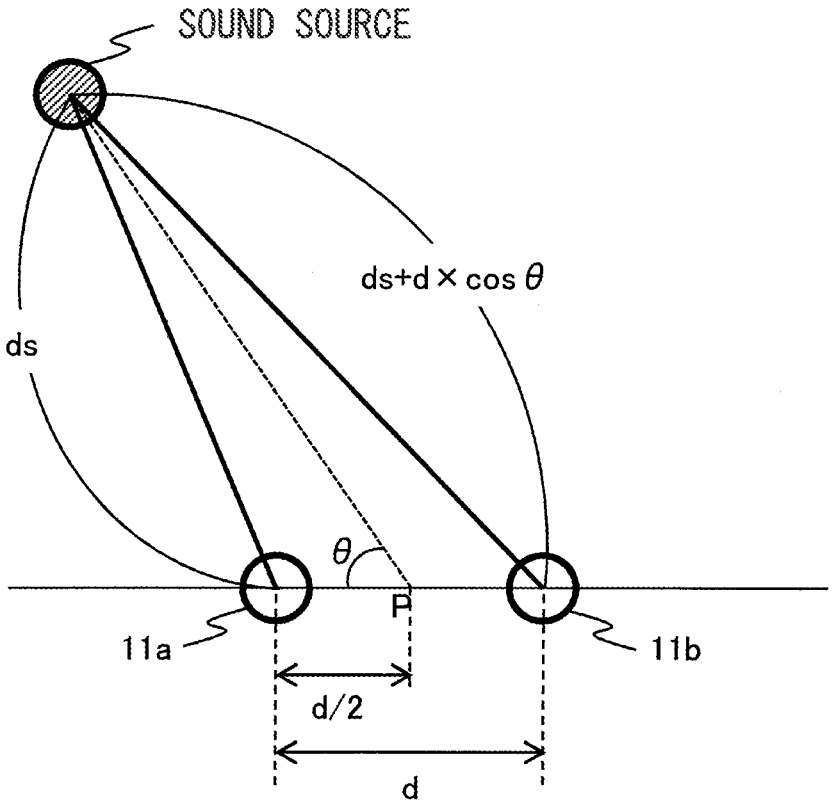
FIG. 8 is a schematic diagram to explain sound source position with respect to a microphone array.

More specifically, as illustrated in FIG. 8, an amplitude ratio R is expressed by following Equation (3), wherein d is the inter-microphone distance, 0° is the sound source direction, and ds is the distance from the sound source to the microphone 11*a*.

$$R=\{ds/(ds+d\times\cos\theta)\}(0\leq\theta\leq180) \quad (3)$$

When the sound source of the target voice to be left remaining without suppression is present from $\theta_{min}$ to $\theta_{max}$ then the amplitude ratio R is a value between $R_{min}$ and $R_{max}$ as expressed by Equation (4) and Equation (5).

$$R_{min}=ds/(ds+d\times\cos\theta_{min}) \quad (4)$$

$$R_{max}=ds/(ds+d\times\cos\theta_{max}) \quad (5)$$

The amplitude condition computation section 14 sets as the amplitude condition to determine that the input sound signal is the target voice the condition that the amplitude ratio R of the input sound signal 1 and the input sound signal 2 is contained in the range $R_{min}$ to $R_{max}$ expressed by the computed $R_{min}$ and $R_{max}$.

The sound input sections 16*a*, 16*b* input the input sound signals 1 and 2 output from the microphone array 11 to the noise suppression device 10.

The sound receiver 18 respectively converts the input sound signals 1 and 2 that are analogue signals input by the sound input sections 16*a*, 16*b* to digital signals at the sampling frequency Fs.

The time-frequency converter 20 respectively converts the input sound signals 1 and 2 that are time domain signals that have been converted to digital signals by the sound receiver 18, into frequency domain signals for each frame, using for example Fourier transformation. Note that the duration of 1 frame may be set at several tens of msec.

The phase difference computation section 22 computes phase spectra respectively for the two input sound signals that have been converted to frequency domain signals by the time-frequency converter 20, in the phase difference utilization range computed by the phase difference utilization range computation section 12 (a frequency band of frequency $F_{max}$ or lower). The phase difference computation section 22 then computes as phase differences the difference between the phase spectra at the same frequencies.

The amplitude ratio computation section 24 computes the respective amplitude spectra of the two input sound signals that have been converted into frequency domain signals by the time-frequency converter 20. The amplitude ratio computation section 24 then computes the amplitude ratio $R_f$ as expressed by the following Equation (6), wherein $IN1_f$ is the amplitude spectrum of the input sound signal 1 at a given frequency f and $IN2_f$ is the amplitude spectrum of the input sound signal 2 at the given frequency f.

$$R_f=IN2_f/IN1_f \quad (6)$$

The phase difference derived suppression coefficient computation section 26 computes the phase difference derived suppression coefficient in the phase difference utilization range computed by the phase difference utilization range computation section 12. The phase difference derived suppression coefficient computation section 26 uses the phase difference computed by the phase difference computation section 22 to identify a probability value representing the probability that the sound source that should remain unsuppressed is present in the sound source direction, namely the probability that the input sound signal is the target voice. The phase difference derived suppression coefficient computation section 26 then computes the phase difference derived suppression coefficient based on the probability value.

Figure 9:
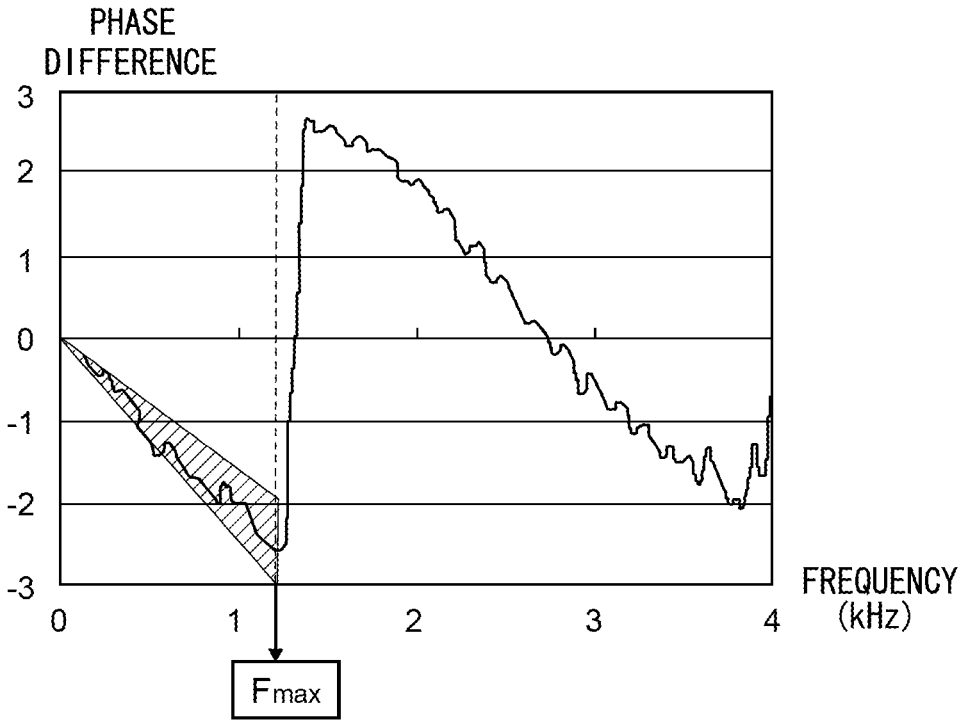
FIG. 9 is a schematic diagram to explain a range of phase difference capable of determining a target voice when noise suppression is performed using phase difference.

For example, explanation follows regarding an example of a computation method of a phase difference derived suppression coefficient α, wherein α is a phase difference derived suppression coefficient. FIG. 9 illustrates phase differences for a case in which the sampling frequency Fs=8 kHz, the inter-microphone distance d is 135 mm and the sound source direction θ is 30°. In such a case, $F_{max}$ is in the vicinity of about 1.2 kHz according to Equation (2). In the frequency band of $F_{max}$ or lower, say the input sound signal that is the input sound signal target voice to be left unsuppressed has a phase difference that is present in the diagonally shaded section of FIG. 9, this then enables a phase difference derived suppression coefficient $\alpha_f$ to be to computed for each of the frequencies f as illustrated below.

$\alpha_f=1.0$ when $f>F_{max}$ $\alpha_f=1.0$ when $f\leq F_{max}$, and the phase difference is within the diagonally shaded range $\alpha_f=\alpha_{min}$ when $f\leq F_{max}$, and the phase difference is outside the diagonally shaded range Note that $\alpha_{min}$ is a value such that $0<\alpha_{min}1$, and when a suppression amount of −3 dB is desired, $\alpha_{min}$ is about 0.7, and when a suppression amount of −6 dB is desired $\alpha_{min}$ is about 0.5. When the phase difference is outside of the diagonally shaded range, the phase difference derived suppression coefficient $\alpha$ is computed so as to gradually change from 1.0 to $\alpha_{min}$ as the phase difference moves away from the diagonally shaded range.

The amplitude ratio derived suppression coefficient computation section 28 determines whether or not the input sound signal is the target voice or noise based on the amplitude conditions computed by the amplitude condition computation section 14, and computes the amplitude ratio derived suppression coefficient.

For example explanation follows regarding an example of a computation method of an amplitude ratio derived suppression coefficient $\beta$ wherein $\beta$ is the amplitude ratio derived suppression coefficient. When the amplitude conditions computed by the amplitude condition computation section 14 have an amplitude ratio $R_f$ contained in the range $R_{min}$ to $R_{max}$ as described above, the amplitude ratio derived suppression coefficient $\beta$ is computed as shown in the following when determining the target voice.

$\beta_f=1.0$ when $R_{min}\leq R_f\leq R_{max}$ $\beta_f=\beta_{min}$ when $R_f<R_{min}$, or $R_f>R_{max}$ Note that $\beta_{min}$ is a value such that $0<\beta_{min}<1$, and when a suppression amount of −3 dB is desired, $\beta_{min}$ is about 0.7, and when a suppression amount of −6 dB is desired $\beta_{min}$ is about 0.5. For the amplitude ratio derived suppression coefficient $\beta$, similarly to for the phase difference derived suppression coefficient $\alpha$, when the amplitude ratio $R_f$ is outside the amplitude conditions range, then the amplitude ratio derived suppression coefficient $\beta$ is computed so as to gradually change from 1.0 to $\beta_{min}$, as shown below as the amplitude ratio moves away from the amplitude condition range.

$\beta_f=1.0$ when $R_{min}\leq R_f\leq R_{max}$ $\beta_f=10(1.0-\beta_{min})R_f-10R_{min}(1.0-\beta_{min})+1.0$ when $R_{min}-0.1\leq R_f\leq R_{min}$ $\beta_f=-10(1.0-\beta_{min})R_f+10R_{max}(1.0-\beta_{min})+1.0$ when $R_{max}\leq A_f\leq R_{max}+0.1$ $\beta_f=\beta_{min}$ when $R_f<R_{min}-0.1, R_f>R_{max}+0.1$ The suppression coefficient computation section 30 computes a suppression coefficient for each frequency to suppress noise from the input sound signal, based on the phase difference derived suppression coefficient computed by the phase difference derived suppression coefficient computation section 26 and based on the amplitude ratio derived suppression coefficient computed by the amplitude ratio derived suppression coefficient computation section 28.

For example, explanation follows regarding an example of a method for computing a suppression coefficient $\gamma$ based on the phase difference derived suppression coefficient $\alpha$ and the amplitude ratio derived suppression coefficient $\beta$. A suppression coefficient $\gamma_f$ at frequency f may be computed as illustrated below by multiplying phase difference derived suppression coefficient $\alpha_f$ by amplitude ratio derived suppression coefficient $\beta_f$.

$\gamma_f=\alpha_f\times\beta_f$

There however no limitation to the above example, and suppression coefficient $\gamma$ may be computed by the average or weighted sum of $\alpha$ and $\beta$.

Moreover, as another method of computing suppression coefficient $\gamma$, the larger degree of suppression out of the phase difference derived suppression coefficient $\alpha$ and the amplitude ratio derived suppression coefficient $\beta$ may be computed as the suppression coefficient $\gamma$. Since the degree of suppression is larger the smaller the values of $\alpha$ and $\beta$, the suppression coefficient $\gamma_f$ at frequency f may be computed according to the following:

$\gamma_f=\alpha_f$ when $\alpha_f<\beta_f$ $\gamma_f=\beta_f$ when $\alpha_f>\beta_f$ The suppression signal generation section 32 generates a suppression signal in which noise has been suppressed by multiplying the amplitude spectrum of the frequencies corresponding to the input sound signal by the suppression coefficient for each frequency computed by the suppression coefficient computation section 30.

The frequency-time converter 34 converts the suppression signal that is a frequency domain signal generated by the suppression signal generation section 32 into an output sound signal that is a time domain signal by employing, for example, an inverse Fourier transform, and outputs the output sound signal.

Figure 10:
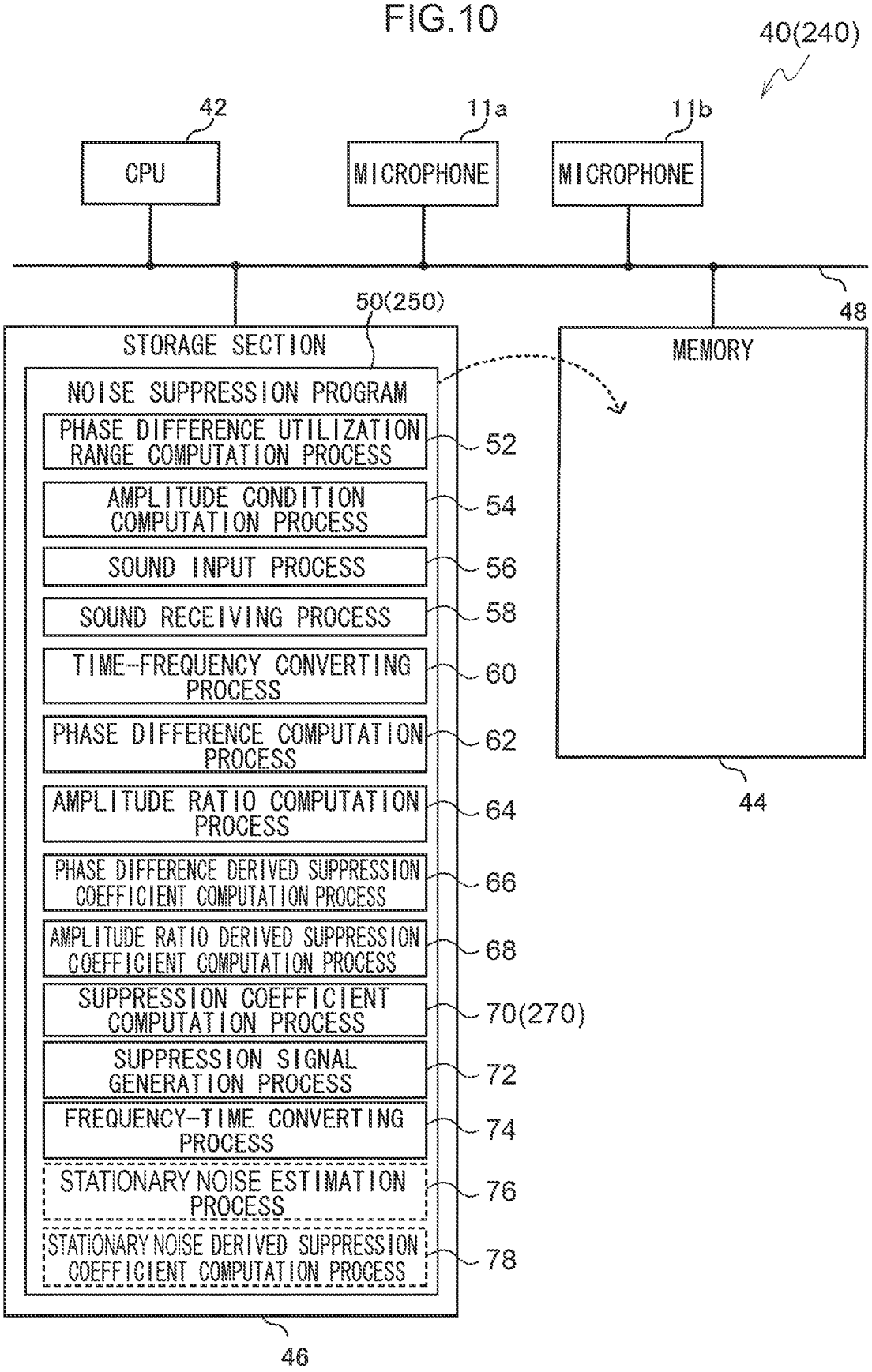
FIG. 10 is a schematic block diagram illustrating an example of a computer that functions as a noise suppression device.

The noise suppression device 10 may for example be implemented by a computer 40 as illustrated in FIG. 10. The computer 40 includes a CPU 42, a memory 44 and a nonvolatile storage section 46. The CPU 42, the memory 44 and the storage section 46 are connected together through a bus 48. The microphone array 11 (the microphones 11*a* and 11*b*) are connected to the computer 40.

The storage section 46 may be implemented for example by a Hard Disk Drive (HDD) or a flash memory. The storage section 46 serving as a storage medium is stored with a noise suppression program 50 for making the computer 40 function as the noise suppression device 10. The CPU 42 reads the noise suppression program 50 from the storage section 46, expands the noise suppression program 50 in the memory 44 and sequentially executes the processes of the noise suppression program 50.

The noise suppression program 50 includes a phase difference utilization range computation process 52, an amplitude condition computation process 54, a sound input process 56, a sound receiving process 58, a time-frequency converting process 60, a phase difference computation process 62 and an amplitude ratio computation process 64. The noise suppression device 50 includes a phase difference derived suppression coefficient computation process 66, an amplitude ratio derived suppression coefficient computation process 68, a suppression coefficient computation process 70, a suppression signal generation process 72 and a frequency-time converting process 74.

The CPU 42 operates as the phase difference utilization range computation section 12 illustrated in FIG. 2 by executing the phase difference utilization range computation process 52. The CPU 42 operates as the amplitude condition computation section 14 illustrated in FIG. 2 by executing the amplitude condition computation process 54. The CPU 42 operates as the sound input sections 16*a*, 16*b* illustrated in FIG. 2 by executing the sound input process 56. The CPU 42 operates as the sound receiver 18 illustrated in FIG. 2 by executing the sound receiving process 58. The CPU 42 operates as the time-frequency converter 20 illustrated in FIG. 2 by executing the time-frequency converting process 60. The CPU 42 operates as the phase difference computation section 22 illustrated in FIG. 2 by executing the phase difference computation process 62. The CPU 42 operates as the amplitude ratio computation section 24 illustrated in FIG. 2 by executing the amplitude ratio computation process 64. The CPU 42 operates as the phase difference derived suppression coefficient computation section 26 illustrated in FIG. 2 by executing the phase difference derived suppression coefficient computation process 66. The CPU 42 operates as the amplitude ratio derived suppression coefficient computation section 28 illustrated in FIG. 2 by executing the amplitude ratio derived suppression coefficient computation process 68. The CPU 42 operates as the suppression coefficient computation section 30 illustrated in FIG. 2 by executing the suppression coefficient computation process 70. The CPU 42 operates as the suppression signal generation section 32 illustrated in FIG. 2 by executing the suppression signal generation process 72. The CPU 42 operates as the frequency-time converter 34 illustrated in FIG. 2 by executing the frequency-time converting process 74. Thus the computer 40 executing the noise suppression program 50 functions as the noise suppression device 10.

Note that the noise suppression device 10 may be implemented by for example a semiconductor integrated circuit, or more specifically by an Application Specific Integrated Circuit (ASIC) and a Digital Signal Processor (DSP).

Explanation next follows regarding operation of the noise suppression device 10 according to the first exemplary embodiment. When the input sound signal 1 and the input sound signal 2 are output from the microphone array 11, the CPU 42 expands the noise suppression program 50 stored in the storage section 46 into the memory 44 and executes the noise suppression processing illustrated in FIG. 11.

Figure 11:
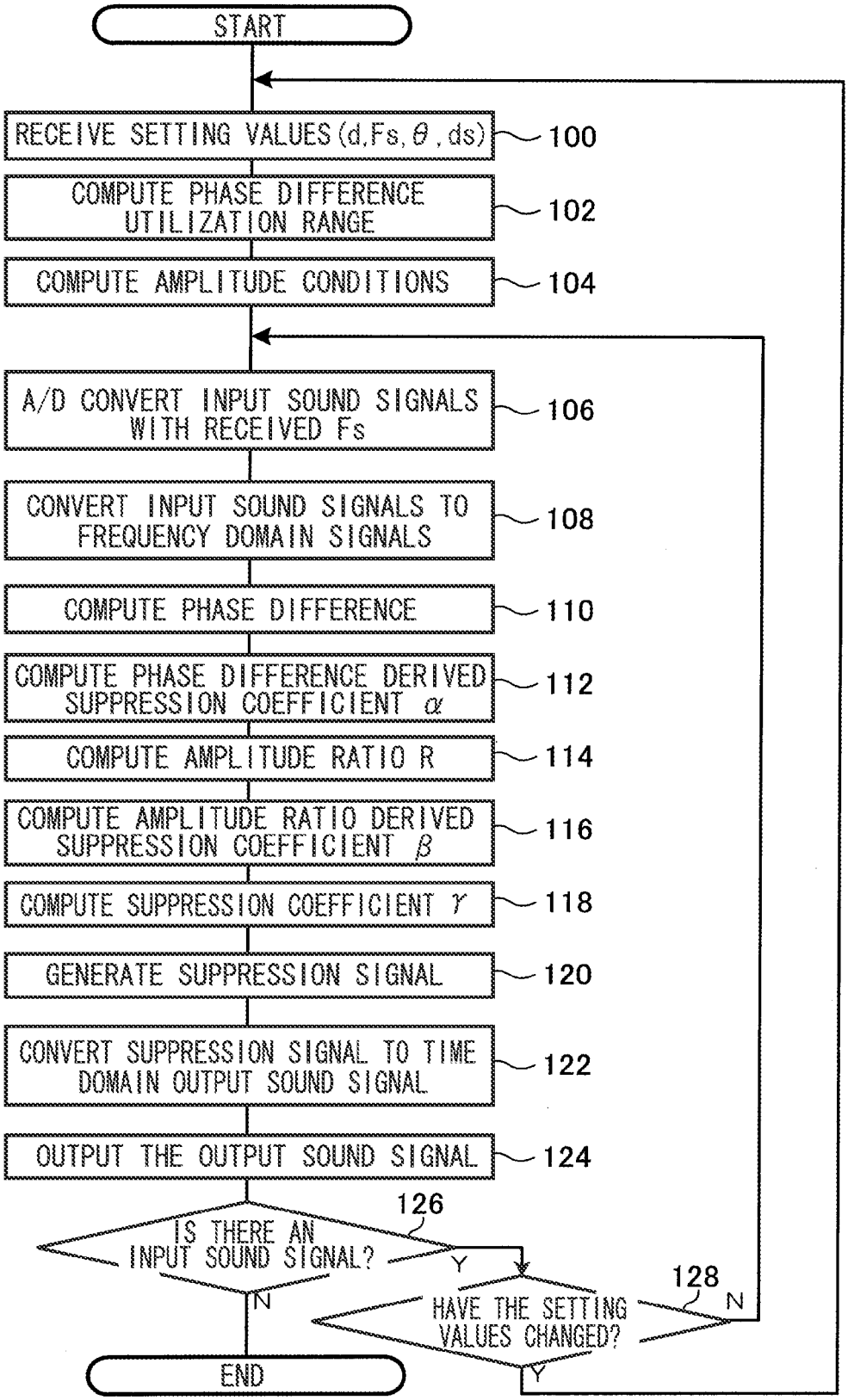
FIG. 11 is a flow chart illustrating noise suppression processing of a first exemplary embodiment.

At step 100 of the noise suppression processing illustrated in FIG. 11, the phase difference utilization range computation section 12 receives the inter-microphone distance d and the sampling frequency Fs. The amplitude condition computation section 14 receives the inter-microphone distance d, the sound source direction θ, and the distance ds from the sound source to the microphone 11*a*. d, Fs, θ and ds are referred to below in general as setting values.

At the next step 102, the phase difference utilization range computation section 12 employs the inter-microphone distance d, the sampling frequency Fs and the speed of sound c received at step 100, and computes the $F_{max}$ according to Equation (1) and Equation (2). The phase difference utilization range computation section 12 then sets a frequency band of computed $F_{max}$ or lower as the phase difference utilization range.

At the next step 104, the amplitude condition computation section 14 uses the inter-microphone distance d, the sound source direction θ, and the distance ds from the sound source to the microphone 11*a* that were received at step 100, and computes the $R_{min}$ as expressed by Equation (4) and the $R_{max}$ as expressed by Equation (5). The amplitude condition computation section 14 then sets amplitude conditions to determine whether or not the input sound signal is the target voice when the amplitude ratio R between the input sound signal 1 and the input sound signal 2 is contained within the range $R_{min}$ to $R_{max}$ expressed by the computed $R_{min}$ and $R_{max}$.

At the next step 106, the sound input sections 16*a*, 16*b* input the noise suppression device 10 with the input sound signal 1 and the input sound signal 2 that have been output from the microphone array 11. The sound receiver 18 then respectively converts the input sound signal 1 and the input sound signal 2 that are analogue signals input by the sound input sections 16*a*, 16*b* into digital signals at sampling frequency Fs.

At the next step 108, the time-frequency converter 20 respectively converts the input sound signal 1 and the input sound signal 2 that are time domain signals converted into digital signals at step 106 into frequency domain signals for each frame.

At the next step 110, the phase difference computation section 22 computes phase spectra in the phase difference utilization range computed at step 102 (the frequency band of frequency $F_{max}$ or lower) for each of the two input sound signals that were converted into frequency domain signals at step 108. The phase difference computation section 22 then computes as the phase difference the difference between the phase spectra at the same frequencies.

At the next step 112, the phase difference derived suppression coefficient computation section 26 computes the phase difference derived suppression coefficient $\alpha_f$ based on the probability that the input sound signal is the target voice for each of the frequencies f in the phase difference utilization range computed at step 102.

At the next step 114, the amplitude ratio computation section 24 computes the amplitude spectra of each of the two input sound signals that were converted into frequency domain signals at step 108. Then the amplitude ratio computation section 24 computes the amplitude ratio $R_f$ as expressed by Equation (6), wherein the amplitude spectrum of the input sound signal 1 at frequency f is $IN1_f$ and the amplitude spectrum of the input sound signal 2 is $IN2_f$.

At the next step 116, the amplitude ratio derived suppression coefficient computation section 28 determines whether or not the input sound signal is the target voice or noise and computes the amplitude ratio derived suppression coefficient of for each of the frequencies f based on the amplitude conditions computed at step 104. Specifically, the amplitude ratio derived suppression coefficient computation section 28 computes an amplitude ratio derived suppression coefficient $\beta_f$ according to whether or not the amplitude ratio $R_f$ computed at step 114 lies within the range $R_{min}$ to $R_{max}$ computed at step 104.

At the next step 118, the suppression coefficient computation section 30 computes suppression coefficient $\gamma_f$ each of the frequencies f, based on the phase difference derived suppression coefficient $\alpha_f$ computed at step 112 and the amplitude ratio derived suppression coefficient $\beta_f$ computed at step 116.

Then at step 120, the suppression signal generation section 32 generates a suppression signal in which noise has been suppressed for each of the frequencies by multiplying the amplitude spectra of the frequency corresponding to the input sound signal by the suppression coefficient $\gamma_f$ at each of the frequencies f computed at step 118.

At the next step 122, the frequency-time converter 34 converts the suppression signal that is the frequency domain signal generated at step 122 into an output sound signal that is a time domain signal, and outputs the output sound signal at step 124.

At the next step 126, determination is made as to whether or not the sound input sections 16*a*, 16*b* have input following input sound signals. Processing proceeds to step 128 when input sound signals have been input, and determination is made as to whether or not any of the setting values of the phase difference utilization range computation section 12 and the amplitude condition computation section 14 have changed. Processing returns to step 106 when none of the setting values have changed, and the processing of steps 106 to 126 is repeated. However, when for example there are plural types of the sampling frequency prepared, such that the sampling frequency automatically switches over according to the output destination of a voice, then determination is made that one of the setting values has changed in cases such as when switching of the sampling frequency has been detected. In such cases, processing returns to step 100, and the changed setting value is received, and then the processing of steps 100 to 126 are repeated.

The noise suppression processing is ended when it is determined at step 126 that no following input sound signals have been input.

As explained above, according to the noise suppression device 10 of the first exemplary embodiment, a frequency band in which phase rotation does not occur is computed based on the inter-microphone distance and the sampling frequency, and a phase difference derived suppression coefficient is computed by utilizing the phase difference in this frequency band. Amplitude conditions are also computed based on the inter-microphone distance and the sound source position when determining whether or not the input sound signal is the target voice or noise by amplitude ratio, and an amplitude ratio derived suppression coefficient is computed according to the inter-microphone distance and the sound source position. Then, using a suppression coefficient computed from the phase difference derived suppression coefficient and the amplitude ratio derived suppression coefficient, the noise contained in the input sound signal is suppressed. Thus even in cases where phase rotation occurs due to the inter-microphone distance, it is possible to perform suppression in a frequency band where phase rotation does not occur by utilizing phase difference to achieve a higher suppression precision than were an amplitude ratio to be employed. Moreover, even when an amplitude ratio is utilized, more appropriate suppression is enabled to be performed by amplitude conditions according to the inter-microphone distance and the sound source position. This accordingly enables noise suppression to be performed with an appropriate suppression amount and low audio distortion even in cases in which there are limitations to the placement positions of a microphone array.

Note that in the amplitude ratio derived suppression coefficient computation section 28, as for example expressed by the following, in the phase difference utilization range (the frequency band of the upper limit frequency $F_{max}$ or lower), the range in which no suppression is performed may be made wider than the frequency band greater than $F_{max}$.

$$R_{min}=0.7, \text{ and } R_{max}=1.4 \text{ when } f>F_{max}$$

$$R_{min}=0.6, \text{ and } R_{max}=1.5 \text{ when } f\leq F_{max}$$

This thereby enables excessive suppression to be avoided in a phase difference utilization range in which suppression is performed utilizing phase difference.

Moreover, configuration may be made such that other than the above formulae, in the suppression coefficient computation section 30 over the phase difference utilization range the phase difference derived suppression coefficient $\alpha$ is employed as the suppression coefficient $\gamma$ irrespective of the value of the amplitude ratio derived suppression coefficient $\beta$.

Moreover, when computing the suppression coefficient $\gamma$ from the phase difference derived suppression coefficient $\alpha$ and the amplitude ratio derived suppression coefficient $\beta$, weighting may be performed to give a greater weighting to the phase difference derived suppression coefficient $\alpha$.

Second Exemplary Embodiment

Figure 12:
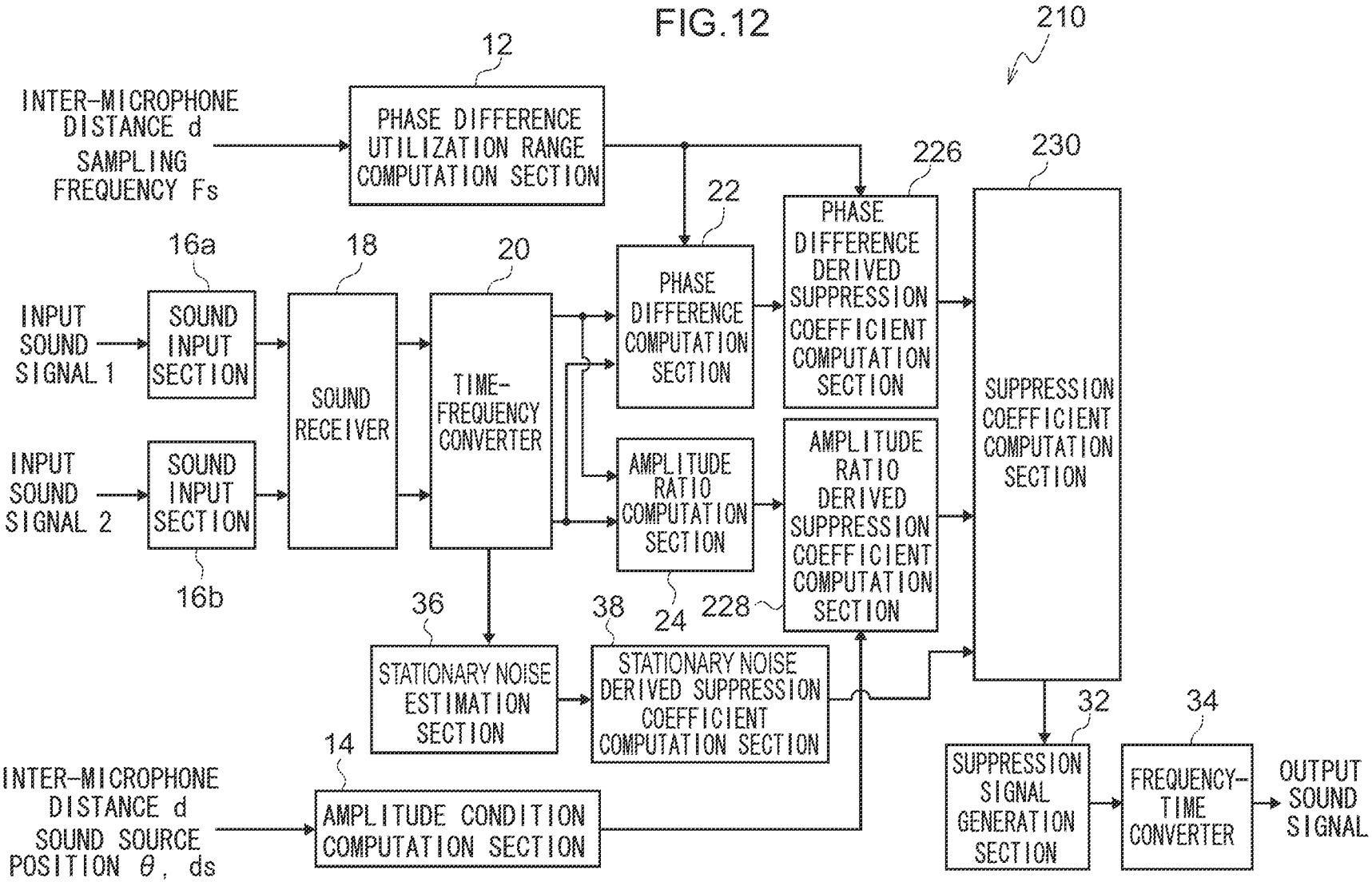
FIG. 12 is a block diagram illustrating an example of a functional configuration of a noise suppression device according to a second exemplary embodiment.

FIG. 12 illustrates a noise suppression device 210 according to the second exemplary embodiment. Note that the same reference numerals are allocated in the noise suppression device 210 according to the second exemplary embodiment to similar parts to those of the noise suppression device 10 of the first exemplary embodiment, and further explanation is omitted thereof.

The noise suppression device 210 includes a phase difference utilization range computation section 12, an amplitude condition computation section 14, sound input sections 16*a*, 16*b*, a sound receiver 18, a time-frequency converter 20, a phase difference computation section 22 and an amplitude ratio computation section 24. The noise suppression device 210 includes a phase difference derived suppression coefficient computation section 226, an amplitude ratio derived suppression coefficient computation section 228, a suppression coefficient computation section 230, a suppression signal generation section 32, a frequency-time converter 34, a stationary noise estimation section 36, and a stationary noise derived suppression coefficient computation section 38. Note that the phase difference computation section 22 and the phase difference derived suppression coefficient computation section 226 are an example of a phase difference derived suppression coefficient computation section of technology disclosed herein. The amplitude ratio computation section 24 and the amplitude ratio derived suppression coefficient computation section 228 are an example of an amplitude ratio derived suppression coefficient computation section of technology disclosed herein. The suppression coefficient computation section 230 and the suppression signal generation section 32 are an example of a suppression section of technology disclosed herein. The stationary noise estimation section 36 and the stationary noise derived suppression coefficient computation section 38 are an example of a stationary noise derived suppression coefficient computation section of technology disclosed herein.

The stationary noise estimation section 36 estimates the level of stationary noise for each of the frequencies based on input sound signals that have been converted by the time-frequency converter 20 into frequency domain signals. Conventional technology may be employed as the method of estimating the level of stationary noise, such as for example the technology described in JP-A No. 2011-186384.

The stationary noise derived suppression coefficient computation section 38 computes the stationary noise derived suppression coefficient based on the level of stationary noise estimated by the stationary noise estimation section 36. Explanation follows regarding an example of a method for computing a stationary noise derived suppression coefficient $\epsilon$ wherein $\epsilon$ is, for example, the stationary noise derived suppression coefficient. When sound from a sound source other than the stationary noise does not occur, the ratio of the input sound signal level and the stationary noise level is a value close to 1.0. However, when sound from a sound source other than the stationary noise is emitted, the ratio of the input sound signal level and the stationary noise level deviates from 1.0.

When the input sound signal level/stationary noise level is a value close to 1.0 (for example 1.1) the stationary noise derived suppression coefficient computation section 38 computes the stationary noise derived suppression coefficient $\epsilon$ as for example shown below as a stationary noise derived suppression range.

$\epsilon=\epsilon_{min}$ when input sound signal level/stationary noise level<1.1

$\epsilon=1.0$ when input sound signal level/stationary noise level≥1.1.

Note that $\epsilon_{min}$ is a value such that $0<\epsilon_{min}<1$, and for example, when a suppression amount of −3 dB is desired, $\epsilon_{min}$ is about 0.7, and when a suppression amount of −6 dB is desired $\epsilon_{min}$ is about 0.5. Similarly to with the phase difference derived suppression coefficient $\alpha$ and the amplitude ratio derived suppression coefficient $\beta$, when the input sound signal level/stationary noise level is outside the suppression range, the stationary noise derived suppression coefficient $\epsilon$ is computed so as to gradually change from 1.0 to $\epsilon_{min}$ on progression away from the suppression range.

The phase difference derived suppression coefficient computation section 226 computes a phase difference derived suppression coefficient outside of the stationary noise derived suppression range. The method of computing the phase difference derived suppression coefficient is similar to that of the phase difference derived suppression coefficient computation section 26 of the first exemplary embodiment.

The amplitude ratio derived suppression coefficient computation section 228 computes an amplitude ratio derived suppression coefficient outside of the stationary noise derived suppression range. The method of computing the amplitude ratio derived suppression coefficient is similar to that of the amplitude ratio derived suppression coefficient computation section 28 of the first exemplary embodiment.

Note that there are cases in the above example in which the stationary noise derived suppression coefficient $\epsilon$ is 1.0 outside of the stationary noise derived suppression range. Moreover, when $\epsilon$ holds values from $\epsilon_{min}$ to 1.0, configuration may be made such that cases in which $\epsilon$ is a specific threshold value $\epsilon_{thr}$ or greater, namely cases in which the degree of suppression derived from stationary noise is a specific value or lower, are treated as being outside the stationary noise derived suppression range.

The suppression coefficient computation section 230 computes a suppression coefficient for each frequency to suppress the noise included in the input sound signal based on the stationary noise derived suppression coefficient, the phase difference derived suppression coefficient, and the amplitude ratio derived suppression coefficient. Explanation follows regarding an example of a computation method of a suppression coefficient $\gamma$.

When the stationary noise derived suppression coefficient $\epsilon$ is made 1.0 outside of the stationary noise derived suppression range, the suppression coefficient $\gamma$ may be computed outside the stationary noise derived suppression range as set out below using the phase difference derived suppression coefficient $\alpha$ and the amplitude ratio derived suppression coefficient $\beta$.

$\gamma=\epsilon$ when $\epsilon\neq1.0$ $\gamma=\alpha\times\beta$, or $\gamma$=the smallest of $\alpha$ or $\beta$ when $\epsilon=1.0$ As another computation method, configuration may be made such that the suppression coefficient $\gamma$ outside of the stationary noise derived suppression range is computed using the $\alpha$ and the $\beta$ as set out below when the stationary noise derived suppression coefficient $\epsilon$ is the specific threshold value $\epsilon_{thr}$ or greater, as cases outside of the stationary noise suppression range.

$\gamma=\epsilon$ when $\epsilon<\epsilon_{thr}$ $\gamma=\alpha\times\beta$, or $\gamma$=the smallest of $\alpha$ or $\beta$ when $\epsilon\geq\epsilon_{thr}$ Moreover, configuration may be made such that without partitioning into a stationary noise derived suppression range, and outside the range, the suppression coefficient $\gamma$ is computed as set out below according to whether or not the input sound signal level is greater than the estimated stationary noise level.

$\gamma=\epsilon$ when the input sound signal level≤the stationary noise level $\gamma$=smallest of $\alpha$, $\beta$ or $\epsilon$ when the input sound signal level>the stationary noise level The noise suppression device 210 may be implemented by a computer 240 as illustrated in FIG. 10. The computer 240 includes a CPU 42, a memory 44 and a nonvolatile storage section 46. The CPU 42, the memory 44 and the storage section 46 are connected together through a bus 48. The microphone array 11 (the microphones 11*a* and 11*b*) are connected to the computer 240.

The storage section 46 may be implemented for example by a Hard Disk Drive (HDD) or a flash memory. The storage section 46 serving as a storage medium is stored with a noise suppression program 250 for making the computer 240 function as the noise suppression device 210. The CPU 42 reads the noise suppression program 250 from the storage section 46, expands the noise suppression program 250 in the memory 44 and sequentially executes the processes of the noise suppression program 250.

The noise suppression program 250 includes, in addition to each of the processes of the noise suppression program 50 according to the first exemplary embodiment, a stationary noise estimation process 76 and a stationary noise derived suppression coefficient computation process 78.

The CPU 42 operates as the stationary noise estimation section 36 illustrated in FIG. 12 by executing the stationary noise estimation process 76. The CPU 42 operates as the stationary noise derived suppression coefficient computation section 38 illustrated in FIG. 12 by executing the stationary noise derived suppression coefficient computation process 78.

Thus the computer 240 executing the noise suppression program 250 functions as the noise suppression device 210.

Note that the noise suppression device 210 may be implemented by for example a semiconductor integrated circuit, or more specifically by an ASIC and a DSP.

Explanation follows regarding operation of the noise suppression device 210 according to the second exemplary embodiment. When the input sound signal 1 and the input sound signal 2 are output from the microphone array 11, the CPU 42 expands the noise suppression program 250 stored in the storage section 46 into the memory 44, and executes the noise suppression processing illustrated in FIG. 13. Note that similar processing in the noise suppression processing of the second exemplary embodiment to that of the noise suppression processing in the first exemplary embodiment is allocated the same reference numerals and further detailed explanation is omitted.

Figure 13:
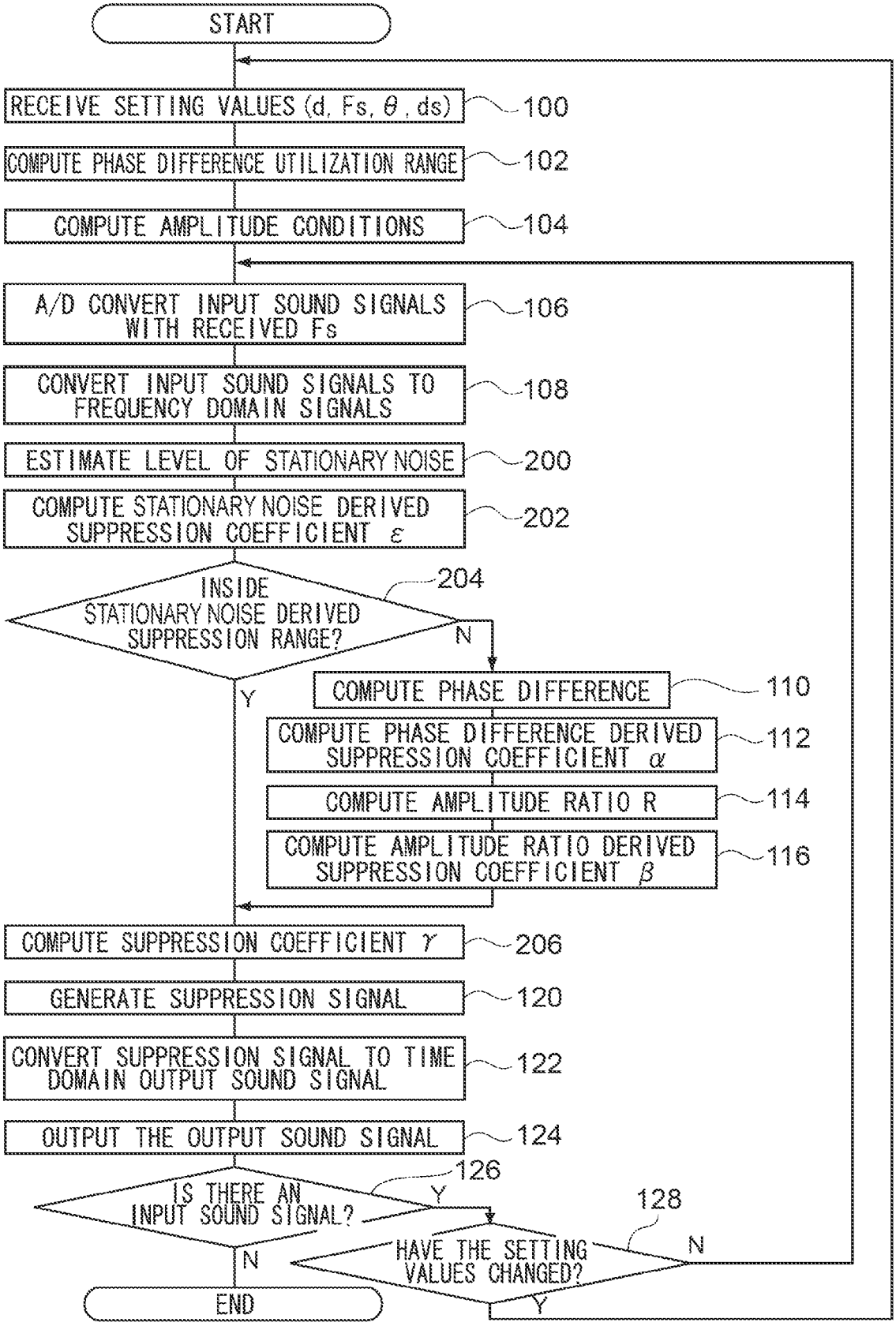
FIG. 13 is a flow chart illustrating noise suppression processing according to the second exemplary embodiment.

Through execution of the steps 100 to 108 of the noise suppression processing illustrated in FIG. 13, the phase difference utilization range and amplitude conditions are computed, and the input sound signals are received, and converted into frequency domain signals.

At the next step 200, the stationary noise estimation section 36 estimates the stationary noise level for each frequency based on the input sound signals that have been converted into frequency domain signals at step 108.

At the next step 202, the stationary noise derived suppression coefficient computation section 38 computes the stationary noise derived suppression coefficient $\epsilon$ based on the ratio of the input sound signal level and the stationary noise level as estimated at step 200.

The stationary noise derived suppression coefficient computation section 38 then determines whether or not the input sound signal is within the stationary noise derived suppression range, based on the stationary noise derived suppression coefficient $\epsilon$ computed at step 202. Processing proceeds to step 206 when inside the stationary noise derived suppression range. Processing proceeds to step 110 when outside the stationary noise derived suppression range, the phase difference derived suppression coefficient $\alpha$ and the amplitude ratio derived suppression coefficient $\beta$ are computed through steps 110 to 116, and processing proceeds to step 206.

At step 206, the suppression coefficient computation section 230 takes the suppression coefficient $\gamma$ as the stationary noise derived suppression coefficient $\epsilon$ computed at step 202 when within the stationary noise derived suppression range. The phase difference derived suppression coefficient $\alpha$ and the amplitude ratio derived suppression coefficient $\beta$ are employed to compute the suppression coefficient $\gamma$ at each frequency when outside the stationary noise derived suppression range.

In the following steps 120 to 128, similar processing is performed to that of the first exemplary embodiment, an output sound signal is output, and the noise suppression processing is ended.

As explained above, according to the noise suppression device 210 according to the second exemplary embodiment, in addition to the advantageous effects of the first exemplary embodiment, suppression is also enabled for stationary noise which is only slightly affected by noise suppression utilizing phase difference or amplitude ratio.

Note that explanation has been given in each of the exemplary embodiments above of cases in which input values are received for the sound source direction and the distance between the microphones and the sound source, however configuration may be made that utilizes a sound source direction and a distance from the sound source to the microphone estimated based on the phase difference computed at the phase difference computation section 22.

Figure 14:
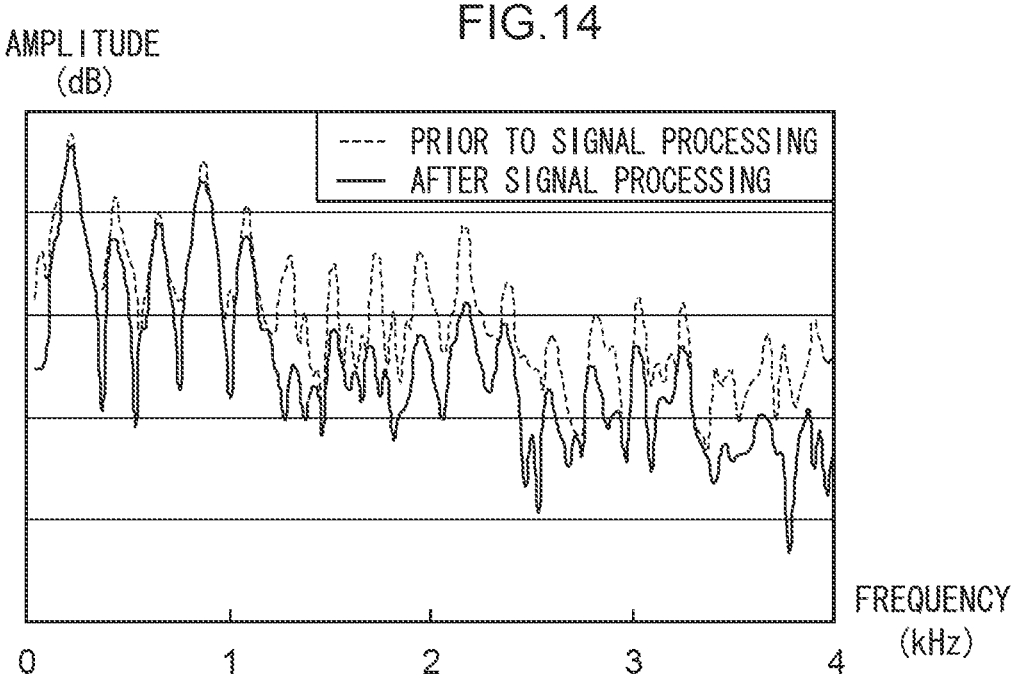
FIG. 14 is a graph illustrating results of noise suppression processing by a conventional method.
Figure 15:
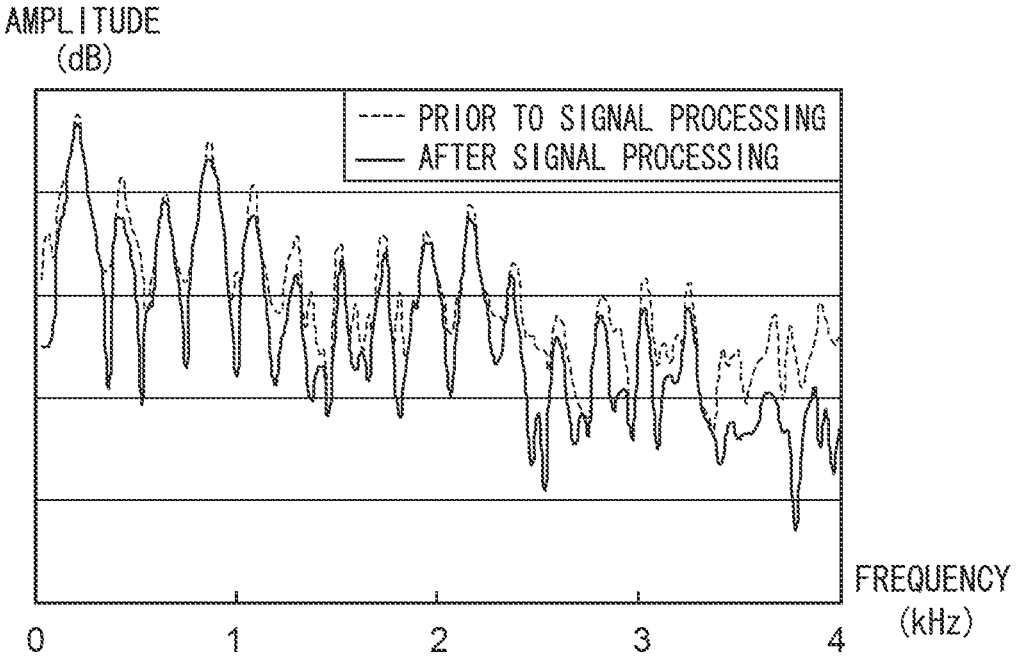
FIG. 15 is a graph illustrating results of noise suppression processing by a method of the technique disclosed herein.

FIG. 14 illustrates results of noise suppression processing performed by a conventional method for a voice mixed in with noise when each of the microphones is placed at a position such that the inter-microphone distance is further apart than the speed of sound/sampling frequency. Moreover, FIG. 15 illustrates for similar conditions results of noise suppression processing when the noise suppression device according to technology disclosed herein is applied. In the conventional method illustrated in FIG. 14, sound components (target voice) in a higher frequency region than 1.2 kHz is suppressed and audio distortion occurs. However it can be seen that, in the method of technology disclosed herein as illustrated in FIG. 15, there are no portions where the voice is suppressed over the entire band width, and audio distortion does not occur.

Thus according to the method of the technology disclosed herein, the degrees of freedom is increased for the placement positions for each of the microphones, enabling implementation with a microphone array mounted to various devices such as smart phones that are becoming increasingly thinner, and enabling noise suppression to be executed without audio distortion.

Note that explanation has been given above of a mode in which the noise suppression programs 50 and 250 serving as examples of a noise suppression program of technology disclosed herein are pre-stored (pre-installed) on the storage section 46. However the noise suppression program of technology disclosed herein may be supplied in a format such as stored on a storage medium such as a CD-ROM or DVD-ROM.

An aspect of technology disclosed herein has the advantageous effect or enabling noise suppression to be performed with an appropriate suppression amount and low audio distortion even when there are limitations to the placement positions of the microphone arrays.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A noise suppression device for suppressing noise, comprising:

a phase difference utilization range computation section that, based on a predetermined relationship between a sampling frequency and an inter-microphone distance between a plurality of microphones contained in a microphone array, computes, as a phase difference utilization range, a frequency band in which phase difference for each frequency between input sound signals stays within a predetermined range without exhibiting phase rotation, the input sound signals containing the noise and a target voice that are input from each of the plurality of microphones;

an amplitude condition computation section that, based on an amplitude ratio or an amplitude difference for each frequency between the input sound signals, computes amplitude conditions to determine whether or not the input sound signals are the noise or the target voice based on the inter-microphone distance and a position of a sound source of the target voice;

a phase difference derived suppression coefficient computation section that, over the phase difference utilization range computed by the phase difference utilization range computation section, computes, for each frequency, a phase difference derived suppression coefficient based on a phase difference;

an amplitude ratio derived suppression coefficient computation section that computes, for each frequency, an amplitude ratio derived suppression coefficient based on the amplitude ratio or the amplitude difference, and based on the amplitude conditions computed by the amplitude condition computation section; and a suppression section that suppresses the noise contained in the input sound signals based on a suppression coefficient determined using the phase difference derived suppression coefficient and the amplitude ratio derived suppression coefficient.

2. The noise suppression device of claim 1, wherein, within the phase difference utilization range, the suppression section determines the suppression coefficient by prioritizing utilization of the phase difference derived suppression coefficient over the amplitude ratio derived suppression coefficient.

3. The noise suppression device of claim 1, wherein, outside of the phase difference utilization range, the suppression section determines the amplitude ratio derived suppression coefficient as the suppression coefficient.

4. The noise suppression device of claim 1, wherein the suppression section determines the suppression coefficient to be:

a value of the product of the phase difference derived suppression coefficient and the amplitude ratio derived suppression coefficient;

an average of the phase difference derived suppression coefficient and the amplitude ratio derived suppression coefficient; or a weighted sum of the phase difference derived suppression coefficient and the amplitude ratio derived suppression coefficient.

5. The noise suppression device of claim 1, wherein the suppression section determines the suppression coefficient to be the coefficient with the larger degree of suppression out of the phase difference derived suppression coefficient and the amplitude ratio derived suppression coefficient.

6. The noise suppression device of claim 1, further comprising:

a stationary noise derived suppression coefficient computation section that computes a stationary noise derived suppression coefficient based on a level of stationary noise estimated based on the input sound signals and a level of the input sound signals; and wherein the suppression section suppresses the noise contained in the input sound signals based on a suppression coefficient determined by using the stationary noise derived suppression coefficient, the phase difference derived suppression coefficient and the amplitude ratio derived suppression coefficient.

7. The noise suppression device of claim 6, wherein the suppression section:

determines the suppression coefficient using the phase difference derived suppression coefficient and the amplitude ratio derived suppression coefficient when a degree of suppression represented by the stationary noise derived suppression coefficient is smaller than a predetermined magnitude; and determines the suppression coefficient to be the stationary noise derived suppression coefficient when the degree of suppression represented by the stationary noise derived suppression coefficient is greater than the predetermined magnitude.

8. The noise suppression device of claim 6, wherein, when the level of the input sound signals is greater than the level of the stationary noise, the suppression section determines the suppression coefficient to be the coefficient with the largest degree of suppression out of the stationary noise derived suppression coefficient, the phase difference derived suppression coefficient and the amplitude ratio derived suppression coefficient.

9. A noise suppression method for suppressing noise that is executed by a computer, the method comprising:

(a) based on a predetermined relationship between a sampling frequency and an inter-microphone distance between a plurality of microphones contained in a microphone array, computing, as a phase difference utilization range, a frequency band in which phase difference stays within a predetermined range without exhibiting phase rotation for each frequency between input sound signals containing the noise and a target voice that are input from each of the plurality of microphones;

(b) based on an amplitude ratio or an amplitude difference for each frequency between the input sound signals, computing amplitude conditions to determine whether or not the input sound signals are the noise or the target voice based on the inter-microphone distance and a position of a sound source of the target voice;

(c) over the computed phase difference utilization range, computing, for each frequency, a phase difference derived suppression coefficient based on a phase difference;

(d) computing, for each frequency, an amplitude ratio derived suppression coefficient based on the amplitude ratio or the amplitude difference, and based on the computed amplitude conditions; and (e) suppressing the noise contained in the input sound signals based on a suppression coefficient determined using the phase difference derived suppression coefficient and the amplitude ratio derived suppression coefficient.

10. The noise suppression method of claim 9, the method further comprising, in (e), determining the suppression coefficient by prioritizing utilization of the phase difference derived suppression coefficient over the amplitude ratio derived suppression coefficient, within the phase difference utilization range.

11. The noise suppression method of claim 9, the method further comprising, in (e), determining the amplitude ratio derived suppression coefficient as the suppression coefficient, outside of the phase difference utilization range.

12. The noise suppression method of claim 9, the method further comprising, in (e), determining the suppression coefficient to be:

a value of the product of the phase difference derived suppression coefficient and the amplitude ratio derived suppression coefficient;

an average of the phase difference derived suppression coefficient and the amplitude ratio derived suppression coefficient; or a weighted sum of the phase difference derived suppression coefficient and the amplitude ratio derived suppression coefficient.

13. The noise suppression method of claim 9, the method further comprising, in (e), determining the suppression coefficient to be the coefficient with the larger degree of suppression out of the phase difference derived suppression coefficient and the amplitude ratio derived suppression coefficient.

14. The noise suppression method of claim 9, the method further comprising:

(f) computing a stationary noise derived suppression coefficient based on a level of stationary noise estimated based on the input sound signals and a level of the input sound signals; and in (e), suppressing the noise contained in the input sound signals based on a suppression coefficient determined by using the stationary noise derived suppression coefficient, the phase difference derived suppression coefficient and the amplitude ratio derived suppression coefficient.

15. The noise suppression method of claim 11, the method further comprising: in (e), determining the suppression coefficient using the phase difference derived suppression coefficient and the amplitude ratio derived suppression coefficient when a degree of suppression represented by the stationary noise derived suppression coefficient is smaller than a predetermined magnitude; and determining the suppression coefficient to be the stationary noise derived suppression coefficient when the degree of suppression represented by the stationary noise derived suppression coefficient is greater than the predetermined magnitude.

16. The noise suppression method of claim 15, the method further comprising: in (e), when the level of the input sound signals is greater than the level of the stationary noise, using, as the suppression coefficient, the coefficient with the largest degree of suppression out of the stationary noise derived suppression coefficient, the phase difference derived suppression coefficient and the amplitude ratio derived suppression coefficient.

17. A storage medium storing a noise suppression program for suppressing noise that causes a computer to execute processing, the processing comprising:

(a) based on a predetermined relationship between a sampling frequency and an inter-microphone distance between a plurality of microphones contained in a microphone array, computing, as a phase difference utilization range, a frequency band in which phase difference stays within a predetermined range without exhibiting phase rotation for each frequency between input sound signals containing the noise and a target voice that are input from each of the plurality of microphones;

(b) based on an amplitude ratio or an amplitude difference for each frequency between the input sound signals, computing amplitude conditions to determine whether or not the input sound signals are the noise or the target voice based on the inter-microphone distance and a position of a sound source of the target voice;

(c) over the computed phase difference utilization range, computing for each frequency, a phase difference derived suppression coefficient based on a phase difference;

(d) computing, for each frequency, an amplitude ratio derived suppression coefficient based on the amplitude ratio or the amplitude difference, and based on the computed amplitude conditions; and (e) suppressing the noise contained in the input sound signals based on a suppression coefficient determined using the phase difference derived suppression coefficient and the amplitude ratio derived suppression coefficient.

18. The storage medium of the claim 17 storing a noise suppression program, the processing further comprising, in (e), determining the suppression coefficient by prioritizing utilization of the phase difference derived suppression coefficient over the amplitude ratio derived suppression coefficient, within the phase difference utilization range.

19. The storage medium of the claim 17 storing a noise suppression program, the processing further comprising, in (e), determining the amplitude ratio derived suppression coefficient as the suppression coefficient, outside of the phase difference utilization range.

20. The storage medium of the claim 17 storing a noise suppression program, the processing further comprising, in (e), determining the suppression coefficient to be:

a value of the product of the phase difference derived suppression coefficient and the amplitude ratio derived suppression coefficient;

an average of the phase difference derived suppression coefficient and the amplitude ratio derived suppression coefficient; or a weighted sum of the phase difference derived suppression coefficient and the amplitude ratio derived suppression coefficient.

21. The storage medium of the claim 17 storing a noise suppression program, the processing further comprising, in (e), determining the suppression coefficient to be the coefficient with the larger degree of suppression out of the phase difference derived suppression coefficient and the amplitude ratio derived suppression coefficient.

22. The storage medium of any one of claim 17 storing a noise suppression program, the processing further comprising:

(f) computing a stationary noise derived suppression coefficient based on a level of stationary noise estimated based on the input sound signals and a level of the input sound signals; and in (e), suppressing the noise contained in the input sound signals based on a suppression coefficient determined by using the stationary noise derived suppression coefficient, the phase difference derived suppression coefficient and the amplitude ratio derived suppression coefficient.

23. The storage medium of claim 22 storing a noise suppression program, the processing further comprising, in (e):

determining the suppression coefficient using the phase difference derived suppression coefficient and the amplitude ratio derived suppression coefficient when a degree of suppression represented by the stationary noise derived suppression coefficient is smaller than a predetermined magnitude; and determining the suppression coefficient to be the stationary noise derived suppression coefficient when the degree of suppression represented by the stationary noise derived suppression coefficient is greater than the predetermined magnitude.

24. The storage medium of claim 22 storing a noise suppression program, the processing further comprising, in (e):

when the level of the input sound signals is greater than the level of the stationary noise, determining, as the suppression coefficient, the coefficient with the largest degree of suppression out of the stationary noise derived suppression coefficient, the phase difference derived suppression coefficient and the amplitude ratio derived suppression coefficient.

* * * * *